US005776883A

United States Patent [19]

Vasudevan

[11] Patent Number: 5,776,883

[45] Date of Patent: Jul. 7, 1998

[54] STRUCTURED LIQUID DETERGENT COMPOSITIONS CONTAINING NONIONIC STRUCTURING POLYMERS PROVIDING ENHANCED SHEAR THINNING BEHAVIOR

[75] Inventor: Tirucherai Varahan Vasudevan, West Orange, N.J.

[73] Assignee: Lever Brothers Company, Division of Conopco, Inc., New York, N.Y.

[21] Appl. No.: 667,315

[22] Filed: Jun. 20, 1996

Related U.S. Application Data

[63] Continuation of Ser. No. 402,669, Mar. 13, 1995, abandoned.

[51] Int. Cl.[6] ..... C11D 3/37

[52] U.S. Cl. ..... 510/470; 510/471; 510/475; 510/476

[58] Field of Search ..... 510/470, 471, 510/473, 475, 476

[56] References Cited

U.S. PATENT DOCUMENTS

| | | | |
|---|---|---|---|
| 4,992,194 | 2/1991 | Liberati et al. | 252/99 |
| 5,006,273 | 4/1991 | Machin et al. | 252/174.23 |
| 5,108,644 | 4/1992 | Machin et al. | 252/174.23 |
| 5,147,576 | 9/1992 | Montague et al. | 252/174 |
| 5,205,957 | 4/1993 | Van de Pas | 252/173 |

*Primary Examiner*—Glenn Caldarola
*Assistant Examiner*—Alexander G. Ghyka
*Attorney, Agent, or Firm*—Ronald A. Koatz

[57] ABSTRACT

The present invention relates to liquid detergent compositions comprising linear or cross-linked, water soluble, highly salt-tolerant, nonionic polymers of MW 10,000 to 1,000,000 Daltons which, when added to structured heavy duty liquids makes the liquid highly shear thinning without decreasing pour viscosity of the composition or increasing it to a point where it is too thick. The compositions are also stable.

4 Claims, No Drawings

STRUCTURED LIQUID DETERGENT COMPOSITIONS CONTAINING NONIONIC STRUCTURING POLYMERS PROVIDING ENHANCED SHEAR THINNING BEHAVIOR

This is a Continuation Application of Ser. No. 08/402,669, filed March 13, 1995, now abandoned.

BACKGROUND OF THE INVENTION

1. Field of the Invention

The present invention relates to aqueous liquid detergent compositions (heavy duty liquids or HDLs) which contain sufficient detergent active material and, optionally, sufficient dissolved electrolyte to result in a structure of lamellar droplets dispersed in a continuous aqueous phase. In particular, the invention is concerned with the preparation of such compositions which are able to suspend relatively large particles without simultaneously causing a large increase in the pour viscosity of the liquids. Such compositions are formed by adding novel water soluble, highly salt tolerant, substantially linear or cross-linked, nonionic, non-adsorbing polymers to an HDL that enhance the shear thinning behavior of the HDLs.

2. Background

The use of water soluble polymers (e.g., polyacrylates) to modify the rheological properties of heavy duty liquids (HDLs) is known.

In each of U.S. Pat. No. 5,006,273 to Machin et al., U.S. Pat. No. 5,108,644 to Machin et al. and U.S. Pat. No. 5,205,957 to Van de Pas et al., for example, viscosity reducing, water soluble polymers such as dextran, dextran sulfonate, polyacrylate, polymethacrylate, acrylatemaleate copolymer and polyethylene glycol and salts thereof are added to detergent compositions to lower the pour viscosity. In U.S. Pat. No. 5,006,273, the polymer claimed is from a group consisting of dextran sulfonate (up to 200,000 to 275,000 Daltons molecular weight), dextran (up to 20,000 Daltons), polyacrylate (up to 5,000 Daltons), acrylate maleate copolymer (up to 70,000 Daltons) and polyethylene glycol (up to 10,000 Daltons). In U.S. Pat. No. 5,205,957, the claimed molecular weight of the functional polymer is less than 2000.

The present invention differs from the cited references in a number of significant ways.

First and foremost, the polymers used in the present invention, which we refer to as structuring polymers, are viscosity enhancing polymers, while similar polymers used in the cited art reduce viscosity.

Second, the molecular weight of the viscosity reducing polymer in the art is not critical. In the present invention, the molecular weight of the polymer is critical, although it varies for each polymer (e.g., Dextran must be at least 35,000 Daltons although it can be as low as 10,000 for other polymers of the invention). While not wishing to be bound by theory, it is believed that the generally higher molecular weight polymers increase shear thinning without decreasing the high shear viscosity and thereby renders the formulation more suitable for suspending large particles. Here, high shear viscosity means viscosity measured at or above a shear rate of 21 $sec^{-1}$. The viscosity measured at 21 $sec^{-1}$ is, henceforth, denoted as the pour viscosity.

Third, while no ceiling level is given for level of surfactant in these references, no example is given with greater than 25% surfactant level. Levels could not be raised higher in the art because the lack of deflocculating polymer (such as the type discussed in U.S. Pat. No. 5,147,576 to Montague et al.) would cause the lamellar droplets to flocculate. By contrast, surfactant used in the compositions of the subject invention are greater than 30% by weight and have been used at levels as high as 45% and in theory could go much higher.

In short, in the references discussed above, lack of deflocculating polymer and the presence of viscosity reducing polymers are believed to have led to flocculation of the lamellar droplets at higher surfactant levels.

U.S. Pat. No. 5,147,576 to Montague et al. cited above does teach lamellar composition with deflocculating polymers. However, the compositions of this reference have poor suspending properties and there is no teaching or recognition that the use of a linear or cross-linked, water soluble, highly salt tolerant, non-adsorbing nonionic polymer of minimum molecular weight 10,000 Daltons (or 35,000 for Dextran) causes the type of shear thinning leading to enhanced suspension, without decreasing or significantly increasing pour viscosity. It is surprising and unexpected to find that incorporation of certain linear or cross-linked, water soluble, highly salt tolerant, non-adsorbing non-ionic polymers in such compositions would have the noted effect.

U.S. Pat. 4,992,194 to Liberati et al. also teaches the use of water soluble polymers of the type disclosed in Montague et al. for the same function, the decrease of pour viscosity of heavy duty liquids, but the specified liquids are characterized as pH jump formulations. A pH jump HDL, defined fully in Liberati et al., is one which contains components that will boost the pH of the wash liquor. Unexpectedly, we find that the structuring polymer enhances the pour viscosity above a critical surfactant concentration of approximately 30%, in contradiction to the teaching of Liberati et al. Furthermore, we also unexpectedly find that the structuring polymer of a specified molecular weight range enhances the shear thinning behavior of the liquid.

In no art is it recognized that use of the structuring polymers of the invention in compositions having a minimum surfactant level will enhance suspending power of that composition without decreasing pour viscosity or without raising it too high.

Finally, in applicants copending U.S. application Ser. No. 081242,224, water-soluble viscosity enhancing polymers are used. However, the polymers in these compositions are ionic polymers, compared to the nonionic polymers of the present invention. Further, those polymers are substantially linear compared to the both linear and cross-linked polymers of the present invention.

SUMMARY OF THE INVENTION

The present invention relates to aqueous liquid detergent compositions having sufficient detergent surfactants (i.e., greater than 30% by weight) and sufficient electrolyte/salt (i.e., at least 1%) to result in a structure of lamellar droplets dispersed in a continuous phase. The composition further contains at least 0.1% by weight deflocculating polymer as described below.

Unexpectedly, it has been found that when a linear or cross-linked, water soluble, highly salt tolerant, non-adsorbing nonionic polymer having a molecular weight of at least 10,000 Daltons, depending on the polymer, is added to such compositions in an amount from about 0.1 to 20% by weight of the formulation, it is possible to enhance the suspending power of the composition without either decreasing the pour viscosity of the composition (i.e., viscosity measured at 21 $sec^{-1}$) or increasing the pour viscosity above 5000 mPas while still maintaining stability.

More specifically, the invention is a liquid detergent composition comprising (a) greater than 30% by weight (i.e., 31% and greater), preferably greater than 30 to 80% by wt. of one or more surfactants predominantly present as lamellar drops dispersed in an aqueous medium containing 1% to 60%, preferably at least 7%, more preferably at least 15% electrolyte.

(b) 0.1% to 20% by weight, preferably 0.5% to 10%, more preferably 1.0% to 5.0% by weight deflocculating polymer; and (c) 0.1 to 20% by weight of a linear or cross-linked, water soluble, highly salt-tolerant, non-adsorbing, nonionic polymer (also referred to as structuring polymer) having a molecular weight of at least 10,000 Daltons (depending on polymer; for example for Dextran, MW must be at least 35,000);

wherein said composition is highly shear thinning;

wherein said structuring polymer does not decrease the pour viscosity of the detergent liquid relative to pour viscosity prior to addition; and wherein stability of said composition means no more than 5% phase separation by volume upon storage at 37° C. for 30 days.

Highly shear thinning is determined by the flow index n of the Sisko rheological model, given by H. Barnes, J. F. Hutton, K. Walters, An Introduction to Rheology, Elsevier, 1989 as follows:

$$\eta=\eta_{\infty}+k\gamma^{-1}$$

wherein $\eta$ and $\eta_{\infty}$ are viscosity at a given shear rate and infinite shear viscosity, respectively, k and n are Sisko model constants and $\gamma$ is the shear rate.

Using this equation, n should be less than 0.35, preferably less than 0.3

Other terms are defined as follows:

Highly salt tolerant means that the polymer is highly soluble, preferably at least 0.1 g in 100 ml, more preferably 1.0 g in 100 ml, and most preferably 10.0 g in 100 ml, in a solution containing 20% citrate or any other salt at a level to match the ionic strength of a 20% citrate solution;

linear means that the contribution to the molecular weight from the branched portion of the molecule is preferably equal to or less than 50%, more preferably equal to or less than 30% and most preferably equal to or less than 10%;

cross-linked means that the contribution to the molecular weight from the linear portion at the molecule is preferably equal to or less than 50%, more preferably equal to or less than 30% and most preferably equal to or less than 10%; and non-adsorbing refers to the lack of physical or chemical adsorption to the lamellar droplets.

DETAILED DESCRIPTION OF THE INVENTION

The present invention relates to aqueous liquid detergent compositions which contain a sufficient amount of detergent surfactant (greater than 30% by wt.) and sufficient dissolved electrolyte (at least 1% by weight) to result in a structure of lamellar droplets dispersed in a continuous aqueous phase.

The compositions of the invention are stable lamellar dispersions comprising: greater than 30% surfactant (i.e., from 31% to 80%) by weight; greater than 1% electrolyte; 0.1% to 20% by weight deflocculating polymer; and 0.1% to 20% by weight of a structuring polymer; wherein, said composition is highly shear thinning. Stable lamellar dispersions have no more than 5% phase separation by volume upon storage at 37° C. for 30 days.

Lamellar Dispersions Lamellar droplets are a particular class of surfactant structures which, inter alia, are already known from a variety of references, e.g. H. A. Barnes, 'Detergents', Ch. 2. in K. Walters (Ed), 'Rheometry: Industrial Applications', J. Wiley & Sons, Letchworth 1980.

Such lamellar dispersions are used to endow properties such as consumer-preferred flow behavior and/or turbid appearance. Many are also capable of suspending particulate solids such as detergency builders or abrasive particles. Examples of such structured liquids without suspended solids are given in U.S. Pat. No. 4,244,840, whilst examples where solid particles are suspended are disclosed in specifications EP-A-160,342; EP-A-38,101; EP-A-104,452 and also in the aforementioned U.S. Pat. No. 4,244,840. Others are disclosed in European Patent Specification EP-A-151,884, where the lamellar droplet are called 'spherulites'.

The presence of lamellar droplets in a liquid detergent product may be detected by means known to those skilled in the art, for example optical techniques, various rheometrical measurements, X-ray or neutron diffraction, and electron microscopy.

The droplets consists of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

In such liquids, there is a constant balance sought between stability of the liquid (generally, higher volume fraction of the dispersed lamellar phase, i.e., droplets, give better stability), the viscosity of the liquid (i.e., it should be viscous enough to be stable but not so viscous as to be unpourable) and solid-suspending capacity (i.e., volume fraction high enough to provide stability but not so high as to cause unpourable viscosity).

A complicating factor in the relationship between stability and viscosity on the one hand and, on the other, the volume fraction of the lamellar droplets is the degree of flocculation of the droplets. When flocculation occurs between the lamellar droplets at a given volume fraction, the viscosity of the corresponding product will increase owing to the formation of a network throughout the liquid. Flocculation may also lead to instability because deformation of the lamellar droplets, owing to flocculation, will make their packing more efficient. Consequently, more lamellar droplets will be required for stabilization by the space-filling mechanism, which will again lead to a further increase of the viscosity.

The volume fraction of droplets is increased by increasing the surfactant concentration and flocculation between the lamellar droplets occurs when a certain threshold value of the electrolyte concentration is crossed at a given level of surfactant (and fixed ratio between any different surfactant components). Thus, in practice, the effects referred to above mean that there is a limit to the amounts of surfactant and electrolyte which can be incorporated whilst still having an acceptable product. In principle, higher surfactant levels are required for increased detergency (cleaning performance). Increased electrolyte levels can also be used for better detergency, or are sometimes sought for secondary benefits such as building.

In U.S. Pat. No. 5,147,576 to Montague et al. it was found that addition of a deflocculating polymer allowed incorporation of more surfactant and/or electrolyte without compromising stability or making the compositions unpourable. The deflocculating polymer is as defined in Montague et al. incorporated by reference into the subject application. The level of deflocculating polymer in the present invention is 0.1 to 20% by weight, preferably 0.5 to 5% by wt., most preferably 1% to 3% by wt.

The compositions of Montague et al., however, even with deflocculating polymer, have poor solids suspending ability. This is evidenced by applicants visual observation of instability when particles in the size range of 500 to 750 microns, with a density that differed from the liquid density by 0.2 to 0.3 specific gravity units, were placed in such liquids.

pH-Jump HDL

A sub-class of lamellar dispersions included in the liquid detergent compositions, or HDLs, relevant to this invention are pH-jump HDLs. A pH-jump HDL is a liquid detergent composition containing a system of components designed to adjust the pH of the wash liquor. It is well known that organic peroxyacid bleaches are most stable at low pH (3–6), whereas they are most effective as bleaches in moderately alkaline pH (7–9) solution. Peroxyacids such as DPDA cannot be feasibly incorporated into a conventional alkaline heavy duty liquid because of chemical instability. To achieve the required pH regimes, a pH jump system has been employed in this invention to keep the pH of the product low for peracid stability yet allow it to become moderately high in the wash for bleaching and detergency efficacy. One such system is borax $10H_2O$/polyol. Borate ion and certain cis 1,2 polyols complex when concentrated to cause a reduction in pH. Upon dilution, the complex dissociates,liberating free borate to raise the pH. Examples of polyols which exhibit this complexing mechanism with borax include catechol, galactitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Bleach component is used in the pH jump composition in an amount from about 0.5 to 10.0% by weight of the composition, preferably 1 to 5% by weight.

Structuring Polymer

The structuring polymer of the invention is a linear or cross-linked, water soluble, highly salt tolerant, non-absorbing, nonionic compound with a molecular weight of at least 10,000 Daltons to 1 million Daltons, preferably 10,000 Daltons to 500,000 Daltons. The molecular weight floor depends on the specific nonionic. Thus, for example, Dextran has a minimum MW of 35,000 while Ficoll has minimum MW of 10,000.

By highly salt tolerant it is meant that the polymer is soluble in solution containing 20% citrate or any other salt at a level that matches the ionic strength of a 20% citrate solution.

By linear it is meant that the contribution to the molecular weight from the branched portion of the molecule is preferably equal to or less than 50%, more preferably less than or equal to 30% and most preferably equal to or less than 10%.

By cross-linked, is meant the contribution to the molecular weight from the linear portion of the molecule is preferably equal to or less than 50%, more preferably equal to or less than 30%, and most preferably equal to or less than 10%.

By non-absorbing it is meant that there is no physical or chemical adsorption to the lamellar drops.

The structuring polymers are selected from, but not limited to, the following nonionic polymers; polyacrylamides, Dextrans and modified Dextrans (e.g., modified with branched hydrophobic groups); and copolymers of sucrose and epichlorohydrin (e.g., Ficoll® ex Fluka).

Unexpectedly, applicants have discovered that the addition of linear or cross-linked, water soluble, highly salt tolerant, non-adsorbing, nonionic polymer (as defined above) of molecular weight at least 10,000 Daltons, (i.e., referred to as structuring polymers) to the compositions described above allows much larger particles to be suspended than previously possible. Suspension properties are achieved by making the composition highly shear thinning without decreasing the pour viscosity (i.e., it does not become thinner), without increasing the pour viscosity above 5000 mPas and naturally, without sacrificing stability.

Highly shear thinning can be quantified by the flow index of the Sisko rheological model, which is given by H. Barnes, J. F. Hutton, K. Walters, An Introduction to Rheology, Elsevier, 1989 as follows:

$$\eta=\eta_{\infty}+k\gamma^{n-1}$$

Using the equation, n should be less than 0.35, preferably less than 0.3.

While not wishing to be bound by theory, these unexpected properties are believed to be caused because the solvated volume of the structuring polymer effectively adds to the dispersed phase volume, thereby increasing the volume fraction and increasing the viscosity, and it is also believed that the structuring polymer forms a network through the continuous phase in quiescent fluid, which is more easily disrupted at higher shear rates, thereby causing the fluid to be more shear thinning. By contrast, it is believed that lower molecular weight polymers compress the lamellar drops in the dispersed phase thereby reducing volume fraction and viscosity.

The level of structuring polymer in the present invention is 0.1% to 20% by wt. and most preferably from 1% to 3%. The average particular weight of the structuring polymer is defined to be greater than 10,000 Daltons (depending on the polymer) and less than one million Daltons, preferably greater than 10,000 Daltons and less than 500,000 Daltons.

Electrolytes

As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g the order of addition of components. On the other hand, the term 'salts' includes all organic and inorganic materials which may be included, other than surfactants and water, whether or not they are ionic, and this term encompasses the sub-set of the electrolytes (water-soluble materials).

The compositions contain electrolyte in an amount sufficient to bring about structuring of the detergent surfactant material. Preferably though, the compositions contain from 1% to 60%, more preferably from 7 to 45%, most preferably from 15% to 30% of a salting-out electrolyte. Salting-out electrolyte has the meaning ascribed to in specification EP-A-79646. Optionally, some salting-in electrolyte (as defined in the latter specification) may also be included, provided if of a kind and in an amount compatible with the other components and the compositions is still in accordance with the definition of the invention claimed herein.

Surfactants

A very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent surfactant material comprises blends of different surfactant types. Typical blends useful for fabric washing compositions include those where the primary surfactant(s) comprise nonionic and/or a non-alkoxylated anionic and/or an alkoxylated anionic surfactant.

The total detergent surfactant material in the present invention is present at from greater than 30% to about 80% by weight of the total composition, preferably from greater than 30% to 50% by weight.

The only restriction on the total amount of detergent surfactant material and electrolyte (if any) is that in the compositions of the invention, together they must result in formation of an aqueous lamellar dispersion. Thus, within the ambit of the present invention, a very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent surfactant material comprises blends of different surfactant types. Typical blends useful for fabric washing compositions include those where the primary surfactant(s) comprise nonionic and/or a non-alkoxylated anionic and/or an alkoxylated anionic surfactant.

In many (but not all) cases, the total detergent surfactant material may be present at from greater than 30% to about 80% by weight of the total composition, for example from greater than 30% to 50% by weight.

In the case of blends of surfactants, the precise proportions of each component which will result in such stability and viscosity will depend on the type(s) and amount(s) of the electrolytes, as is the case with conventional structured liquids.

In the widest definition the detergent surfactant material in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, Munchen & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides and dialkyl sulphoxides.

Other suitable nonionics which may be used include aldobionamides such as are taught in U.S. application Ser. No. 981,737 to Au et al. and polyhydroxyamides such as are taught in U.S. Pat. No. 5,312,954 to Letton et al. Both of these references are hereby incorporated by reference into the subject application.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulfuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{10}$–$C_{18}$) alkyl sulphates.

It is also possible, to include an alkali metal soap of a long chain mono- or dicarboxylic acid, for example, one having from 12 to 18 carbon atoms.

Other Ingredients

Preferably the amount of water in the composition is from 5 to 69%, more preferred from 20 to 65%, most preferred from 25 to 50%. Especially preferred less than 45% by weight.

Some or all of the electrolyte (whether salting-in or salting-out), or any substantially water-insoluble salt which may be present, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1,302,543.

Examples of organic detergency builders, when present, include the alkaline metal, ammonium and substituted ammonium polyacetates, carboxylates, polycarboxylates, polyacetyl carboxylates, carboxymethyl oxysuccinates, carboxymethyloxymalonates, ethylene diamine-N,N, disuccinic acid salts, polyepoxysuccinates, oxydiacetates, triethylene tetramine hexacetic acid salts, N-alkyl imino diacetates or dipropionates, alpha sulpho-fatty acid salts, dipicolinic acid salts, oxidized polysaccharides, polyhydroxysulphonates and mixtures thereof.

Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid, tartrate mono succinate and tartrate di-succinate.

The deflocculating polymer is as defined in U.S. Pat. No. 5,147,576 to Montague et al. incorporated by reference into the subject application.

Although it is possible to incorporate minor amounts of hydrotropes such as lower alcohols (e.g., ethanol) or alkanolamines (e.g., triethanolamine), in order to ensure integrity of the lamellar dispersion we prefer that the compositions of the present invention are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids,fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and usually present in very minor amounts, fluorescent agents, perfumes, enzymes such as proteases, amylases and lipases (including Lipolase (Trade Mark) ex Novo), germicides and colorants.

Among these optional ingredients, as mentioned previously, are agents to which lamellar dispersions without deflocculating polymer are highly stability-sensitive and by virtue of the present invention, can be incorporated in higher, more useful amounts. These agents cause a problem in the absence of deflocculating polymer because they tend to promote flocculation of the lamellar droplets. Examples of such agents are soluble polymers, soluble builder such as succinate builders, fluorescers like Blankoophor RKH, Tinopal LMS, and Tinopal DMS-X and Blankophor BBH as well as metal chelating agents, especially of the phosphonate type, for example the Dequest range sold by Monsanto.

The invention will now be illustrated by way of the following Examples. In all Examples, unless stated to the contrary, all percentages are by weight.

Materials

Surfactants: Linear alkylbenzenesulfonic acid (LAS acid) and Neodol 25–9 (alcohol ethoxylate; $C_{12-15}EO_9$) were of commercial grade and were supplied by Vista Chemicals and Shell Chemicals respectively.

Polymers: Dextrans of all the molecular weights used in the examples as well as Ficoll 70,000 Daltons were purchased from Fluka. Polyacrylamides of all the molecular weights used in the examples were supplied by Polysciences. Dextrans and polyacrylamides are, by our definition, substantially linear nonionic polymers, while Ficoll, by our definition, is a cross-linked polymer. The structure of polyacrylamide is shown in "Water-soluble synthetic polymers: properties and behavior" by Philip Molyneux, Vol. 1, Chapter 3, pg 84, 1983 CRC Press. The structures of Dextran and Ficoll are shown in the article by W. M. Deen, M. P Bohner and N. B. Epstein in American Institute of Chemical Engineering Journal [AIChEJ], Vol. 27, No. 6, Pg. 952–959, 1981, hereby incorporated by reference into the subject application. Ficoll, specifically, is a cross-linked copolymer of sucrose and epichlorohydrin.

Inorganic Reagents: Sodium citrate dihydrate used was of analytical reagent grade and was purchased from Aldrich Chemicals. 50 weight percent sodium hydroxide of analytical reagent grade was supplied by Fisher Scientific Company.

Other Reagents: Deionized water was used in all the formulations and for reagent dilution.

The following examples are intended for illustrative purposes only and are not intended to limit the claims in any way.

All percentages, unless stated otherwise, are intended to be percentages by weight.

EXAMPLE 1

(Comparative—This example shows the effect of surfactant actives, in the absence of structuring polymer, on the shear thinning behavior).

The following composition was prepared by first adding sodium citrate to water. After dissolution of sodium citrate, that is after the solution becomes visibly clear, 50% solution of sodium hydroxide was added followed by the decoupling polymer (Narlex DC-1) and the detergent surfactants (premix of LAS acid and Neodol 25–9) in that sequence. The composition was continuously stirred and maintained at 55° C. during the additions. After completion of surfactants addition, stirring was continued for 30 minutes after which the formulation was cooled down to the room temperature.

Formulation Composition

| Component | Parts |
|---|---|
| LAS-acid | 21.0–31.5 |
| Neodol 25-9 | 9.0–13.5 |
| Total surfactants | 30.0–45.0 |
| Na-citrate $2H_2O$ | 14.2–18.4 |
| Narlex DC-1 (33% solution) | 4.5 |
| Deionized water | up to 100 parts |

These ratios were maintained constant in various formulations:

LAS acid/50% NaOH=3.9

LAS acid/Neodol 25-9=2.33

Na-citrate. $2H_2O$/(0.056 LAS acid+0.67 Narlex DC-1+0.75 Dextran+0.50%

NaOH+DI water), all in parts=0.385

The following results were obtained:

| Total Surfactants wt % | Sisko Index "n" | Pour Viscosity $\eta_{211/s}$, mPas | BLS* @ 37° C., 1 month % (v/v) |
|---|---|---|---|
| 35.0 | 0.39 | 224 | 0.0 |
| 37.5 | 0.44 | 290 | 0.0 |
| 40.0 | 0.46 | 395 | 0.4 |
| 45.0 | 0.48 | 957 | 0.3 |

*BLS-Bottom layer separating; a measure of physical stability. Measured as percent of total volume that separate to form a bottom clear layer.

* BLS—Bottom layer separating; a measure of physical stability. Measured as percent of total volume that separate to form a bottom clear layer.

The example shows that increasing the surfactants concentration renders the formulation less shear thinning as seen by the increasing value of "n". However, the effect of surfactant concentration is quite marginal as the increase in "n" value is small.

EXAMPLE 2

(Comparative)

This example also shows the effect of structuring polymer concentration on the shear thinning behavior of the formulation. Structuring polymer used was Dextran of 6,000 Daltons. The procedure for the preparation of formulation was the same as described in Example 1, except that addition of structuring polymer precedes the addition of decoupling polymer.

The following results were obtained:

Total surfactants=37.5 wt. %

Dextran molecular weight=6,000 Daltons

| Dextran conc. wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 1.0 | 0.40 | 335 | N/A |
| 1.5 | 0.41 | 272 | N/A |
| 2.5 | 0.42 | 432 | 0.46 |
| 5.0 | 0.52 | 831 | 0.31 |

This example shows that increasing the structuring polymer concentration results in a decrease of Sisko "n" (enhanced shear thinning) which increases above a polymer concentration of 2.5 wt. %. The minimum value of Sisko "n" obtained was 0.40 and the pour viscosity was less than 1,000 mPas in the entire polymer concentration range tested.

EXAMPLE 3

(Comparative)

This example also shows the effect of structuring polymer concentration on the shear thinning behavior of the formulation. Structuring polymer used in this case was Dextran of 15,000–20,000 Daltons. The procedure for the preparation of formulation was the same as described in Example 2.

The Following Results Were Obtained:

Total surfactants=37.5 wt. %

Dextran molecular weight=15,000–20,000 Daltons

| Dextran conc. wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 0.5 | 0.37 | 400 | 0.54 |
| 1.5 | 0.36 | 556 | 0.32 |
| 2.0 | 0.34 | 708 | 0.52 |
| 3.0 | 0.49 | 1308 | 0.16 |
| 4.0 | 0.54 | 1338 | 0.26 |
| 5.0 | 0.60 | 1907 | 0.19 |

This example shows that increasing the structuring polymer concentration results in a decrease of Sisko "n" (enhanced shear thinning) which increases above a polymer concentration of 2.0 wt. %. The minimum value of Sisko "n" obtained was 0.34 and the pour viscosity was less than 2000 mPas in the entire polymer concentration range tested.

EXAMPLE 4

This example shows the effect of surfactant concentration on the shear thinning behavior of the formulation. Structuring polymer used in this case was Dextran of 40,000 Daltons. The procedure for the preparation of formulation was the same as described in Example 2.

The Following Results Were Obtained:

Total surfactants=37.5 wt. %

Dextran Molecular weight=40,000 Daltons

| Dextran Concentration wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 0.5 | 0.39 | 441 | 0.44 |
| 1.0 | 0.23 | 489 | 0.86 |
| 1.5 | 0.18 | 679 | 0.33 |
| 2.0 | 0.17 | 829 | 1.05 |

This example shows that incorporating the structuring polymer results in a substantial decrease of Sisko "n" (enhanced shear thinning), but the decrease is marginal above a polymer concentration of 1.5 wt. %. The pour viscosity (viscosity at 21 1/s) is well below 1000 mPas in the entire polymer concentration range tested.

EXAMPLE 5

This example shows the effect of structuring polymer concentration on the shear thinning behavior of the formulation. Structuring polymer used in this case was Dextran of 35,000–50,000 Daltons. The procedure for the preparation of formulation as the same as described in Example 2.

The following results were obtained:

Total surfactants=37.5 wt. %

Dextran 35,000–50,000 Daltons

| Dextran Concentration wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 0.5 | 0.46 | 474 | 0.27 |
| 1.0 | 0.29 | 490 | 0.96 |

-continued

| Dextran Concentration wt % | Sisko Index "n" | Pour Viscosity $\eta_{211/s}$, mPas | BLS @ 37° C., 1 month % (v/v) |
|---|---|---|---|
| 1.5 | 0.24 | 632 | 0.31 |
| 2.0 | 0.18 | 766 | 2.58 |
| 2.5 | 0.22 | 1237 | N/A |
| 3.0 | 0.23 | 1247 | N/A |

This example shows that incorporating the structuring polymer results in a decrease of Sisko "n" (enhanced shear thinning) to well below 0.3, while keeping the pour viscosity (viscosity at 21 $s^{-1}$) well below 5000 mPas. There is no benefit of increasing the structuring polymer concentration above 2 wt. % since both Sisko index as well as pour viscosity increase above 2 wt. % structuring polymer.

EXAMPLE 6

This example also shows the effect of structuring polymer concentration on the shear thinning behavior of the formulation. Structuring polymer used in this case was Dextran of 500,000 Daltons. The procedure for the preparation of formulation was the same as described in Example 2.

The Following Results Were Obtained:

Total surfactants=37.5 wt. %

Dextran Molecular weight=500,000 Daltons

| Total Surfactants wt % | Sisko Index "n" | Pour Viscosity $\eta_{211/s}$, mPas | BLS @ 37° C., 1 month % (v/v) |
|---|---|---|---|
| 0.0 | 0.440 | 290 | 0.00 |
| 0.5 | 0.240 | 565 | 0.47 |
| 1.0 | 0.235 | 1004 | 1.07 |
| 1.5 | 0.220 | 1912 | 0.51 |
| 2.0 | 0.140 | 3008 | 0.00 |

This example shows that incorporating the structuring polymer results in a decrease of Sisko "n" (enhanced shear thinning) to well below 0.3, while keeping the pour viscosity (viscosity at 21 $s^{-1}$) below 5000 mPas.

EXAMPLE 7

This example also shows the effect of structuring polymer concentration on the shear thinning behavior of the formulation. Structuring polymer used in this case was Ficoll, a highly cross-linked nonionic polymer different from highly linear Dextran, of 70,000 Daltons. The procedure for the preparation of formulation was the same as described in Example 1.

The Following Results Were Obtained:

Total surfactants–37.5 wt. %

Ficoll Molecular weight=70,000 Daltons

| Total Surfactants wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 1.0 | 0.40 | 378 | 0.47 |
| 3.6 | 0.26 | 1020 | 1.36 |

This example shows that incorporating the structuring polymer results in a decrease of Sisko "n" (enhanced shear thinning). However, decrease in "n" value is marginal above a Ficoll concentration of 2.0 wt. %. The maximum value of pour viscosity (viscosity at 21 $s^{-1}$) in the concentration range tested was 1020 mPas.

EXAMPLE 8

This example also shows the effect of structuring polymer concentration on the shear thinning behavior of the formulation. Structuring polymer used in this case was polyacrylamide, a non-sugar based nonionic polymer different for sugar-based Dextran and Ficoll, of 10,000 Daltons. The procedure for the preparation of formulation was the same as described in Example 2.

The Following Results Were Obtained:

Total surfactants=37.5 wt. %

Polyacrylamide (PAM) Molecular weight=10,000 Daltons

| PAM conc. wt. % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 1.0 | 0.37 | 245 | 0.29 |
| 4.0 | 0.24 | 1655 | 0.50 |
| 5.0 | 0.31 | 2220 | 0.00 |

This example shows that incorporating the structuring polymer results in a decrease of Sisko "n" (enhanced shear thinning). However, above 4 wt. % polyacrylamide, there is an increase in "n". The maximum value of pour viscosity (viscosity at 21 $s^{-1}$) in the concentration range tested was 2220 mPas.

EXAMPLE 9

This example also shows the effect of structuring polymer concentration on the shear thinning behavior of the formulation. Structuring polymer used in this case was polyacrylamide of 1,000,000 Daltons molecular weight. The procedure for the preparation of formulation was the same as described in Example 2.

The Following Results Were Obtained:

Total surfactants=37.5 wt. %

Polyacrylamide Molecular weight=1,000,000 Daltons

| Dextran conc. wt % | Sisko Index "n" | Pour Viscosity $\eta_{211/s}$, mPas | BLS @ 37° C., 1 month % (v/v) |
|---|---|---|---|
| 0.0 | 0.44 | 290 | 0.00 |
| 0.2 | 0.26 | 245 | 0.00 |
| 0.5 | 0.18 | 2362 | 0.00 |

This example shows that incorporating the structuring polymer results in a decrease of Sisko "n" (enhanced shear thinning) to below 0.3, while keeping the pour viscosity (viscosity at 21 $s^{-1}$) well below 5000 mPas.

EXAMPLE 10

This example also shows the effect of surfactant concentration in the presence of structuring polymer Dextran of 40,000 Daltons molecular weight.

Dextran 40,000 Daltons=8.0 wt. % (25 wt. % solution)

| Total Surfactants wt % | Sisko Index "n" | Pour Viscosity $\eta_{211/s}$, mPas | BLS @ 37° C., 1 month % (v/v) |
|---|---|---|---|
| 30.0 | 0.18 | 561 | 0.00 |
| 32.5 | 0.16 | 530 | 3.10 |
| 35.0 | 0.14 | 662 | 1.80 |

-continued

| Total Surfactants wt % | Sisko Index "n" | Pour Viscosity $\eta_{211/s}$, mPas | BLS @ 37° C., 1 month % (v/v) |
|---|---|---|---|
| 37.5 | 0.17 | 829 | 1.50 |
| 40.0 | 0.24 | 1427 | 1.30 |
| 42.5 | 0.27 | 2829 | 0.00 |

This example shows that in the presence of the structuring polymer, increasing the surfactants concentration has only a marginal effect on Sisko "n", at least up to a surfactant concentration of 37.5 wt. %. Above this concentration, although the Sisko "n" increases the value is still below 0.3.

EXAMPLE 11

This example shows the effect of surfactant concentration in the presence of structuring polymer Dextran of 35,000–50,000 Daltons molecular weight.

Dextran 40,000 Daltons=8.0 wt. % (25 wt. % solution)

| Total Surfactants wt % | Sisko Index "n" | Pour Viscosity $\eta_{211/s}$, mPas | BLS @ 37° C., 1 month % (v/v) |
|---|---|---|---|
| 32.5 | 0.19 | 502 | 0.59 |
| 37.5 | 0.18 | 766 | 0.34 |
| 40.0 | 0.27 | 1509 | 0.00 |
| 42.5 | 0.25 | 1922 | 0.00 |

This example shows that in the presence of the structuring polymer, increasing the surfactants concentration has only a marginal effect on Sisko "n", at least up to a surfactant concentration of 37.5 wt. %. Above this concentration, although the Sisko "n" increases the value is still below 0.3.

EXAMPLE 12

This example also shows the effect of decoupling polymer concentration in the presence of structuring polymer Dextran of 40,000 Daltons molecular weight.

Dextran 40,000 Daltons=8.0 wt. % (25 wt. % solution)

| Decoupling polymer wt. % | Sisko Index "n" | Pour Viscosity $\eta_{211/s}$, mPas | BLS @ 37° C., 1 month % (v/v) |
|---|---|---|---|
| 0.5 | 0.27 | 773 | 3.90 |
| 1.0 | 0.25 | 1132 | 0.80 |
| 2.0 | 0.24 | 1622 | 2.40 |

This example shows that in the presence of the structuring polymer, increasing the decoupling polymer concentration has only a marginal effect on Sisko "n", at least up to a decoupling polymer concentration of 2.0 wt. %

EXAMPLE 13

The following composition, to be referred to as "pH jump formulation", was prepared by first adding sodium citrate and sodium borate to water. After dissolution of citrate and borate, that is after the solution becomes visibly clear, desired amount of a 70 wt. % aqueous solution of sorbitol was added followed by 50% solution of sodium hydroxide, ethylenediamine tetraacetic acid (EDTA), the fluorescer, the decoupling polymer (Narlex DC-1) and the detergent surfactants (premix of LAS acid and Neodol 25–9) in that sequence. The composition was continuously stirred and maintained at 55° C. during the additions. After completion of surfactants addition, stirring was continued for 30 minutes after which the formulation was cooled down to the room temperature (=25° C.). Required amount of a 30 weight percent wet cake of peracid bleach (TPCAP, N,N'-tetraphthaloyl-di- 6-aminocaproic peracid) was then added to the formulation and the stirring continued until the particles were homogeneously dispersed, that is until no clumps of the wet cake are seen. Desired amount of the structuring polymer (Dextran 40,000 Daltons) was then added and the suspension stirred for 30 more minutes.

pH—jump formulation containing peracid bleach particles (TPCAP)

Formulation Composition

| Component | Parts |
|---|---|
| LAS-acid | 22.7 |
| Neodol 25-9 | 10.4 |
| Total surfactants | 33.1 |
| 50% NaOH | 5.7 |
| Na-citrate $2H_2O$ | 8.2 |
| Borax | 3.2 |
| Sorbitol (70 wt. % solution) | 13.3 |
| Dextran (25 wt. % solution) | 0.0 or 4.0 |
| Narlex DC-1 (33 wt. % solution) | 4.5 |
| Fluorescer | 0.2 |
| EDTA | 0.9 |
| TPCAP (30 wt. % wet cake) | 6–16 |
| Deionized water | up to 100 parts |

The Following Results Were Obtained:

| Formulation | Sisko Index "n" | Pour Viscosity $\eta_{211/s}$, mPas | BLS @ 37° C., 1 month % (v/v) |
|---|---|---|---|
| pH jH jump with 3.6% TPCAP | 0.43 | 551 | 0.0 |
| pH jump with 1.8% TPCAP & Dextran | 0.23 | 915 | 0.73 |
| pH jump with 3.6% TPCAP & Dextran | 0.31 | 2046 | 0.0 |
| pH jump with 4.8% TPCAP & Dextran | 0.29 | 1646 | 0.0 |

This example shows that Dextran of 40,000 Daltons significantly decreases the Sisko "n" value from 0.43 to 0.30 also in the pH jump formulation containing peracid bleach (TPCAP) particles.

I claim:

1. A liquid detergent composition comprising:

(a) 30% and up to about 80% by wt. of one or more surfactants predominantly present as lamellar drops dispersed in an aqueous medium containing at least 1% by wt. electrolyte;

(b) 0.1% to 20% by wt. deflocculating polymer;

(c) about 0.5% to about 10% by weight of a sucrose epichlorohydrin copolymer;

wherein the composition has a Sisko Index of 0.40 or less as measured by Sisko rheological model;

wherein said sucrose epichlorohydrin polymer does not decrease the viscosity of the composition as measured at 21 $sec^{-1}$, relative to viscosity prior to addition of said polymer;

wherein said sucrose epichlorohydrin copolymer does not increase the viscosity, as measured at 21 $sec^{-2}$, above 5,000 mPas; and wherein said composition results in no more than 5% bottom clear layer separation by volume upon storage at 37° C. for 30 days.

2. A composition according to claim 1, additionally comprising a pH jump system comprising (a) 1% to 25% by wt. total composition sorbitol; and (b) 0.5% to 10% by wt. of total composition of a boron containing compound in addition to any boron containing compound which is present as electrolyte.

3. A liquid detergent composition comprising:

(a) 30% and up to about 80% by wt. of one or more surfactants predominantly present as lamellar drops dispersed in an aqueous medium containing at least 1% by wt. electrolyte;

(b) 0.1% to 20% by wt. deflocculating polymer;

(c) about 0.1% to 10% by wt. of a polyacrylamide having a molecular weight of 10,000 to 1 million;

wherein the composition has a Sisko Index of 0.37 and below as measured by Sisko rheological index;

wherein said polyacrylamide does not decrease the viscosity of the composition as measured at 21 $sec^{-1}$, relative to viscosity prior to addition of said polymer;

wherein said polyacrylamide does not increase the viscosity, as measured at 21 $sec^{-1}$, above 5,000 mPas; and wherein said composition results in no more than 5% bottom clear layer separation by volume upon storage at 37° C. for 30 days.

4. A composition according to claim 3, additionally comprising a pH jump system comprising:

(a) 1% to 25% by wt. total composition sorbitol; and (b) 0.5% to 10% by wt. of total composition of a boron containing compound in addition to any boron containing compound which is present as electrolyte.

* * * * *